United States Patent [19]

Schoeps et al.

[11] Patent Number: 4,854,916

[45] Date of Patent: Aug. 8, 1989

[54] HYDRAULIC TORQUE IMPULSE GENERATOR WITH BYPASS MECHANISM

[75] Inventors: Knut C. Schoeps, Tyresö; Sven P. J. Westerberg, Saltsjöbaden, both of Sweden

[73] Assignee: Atlas Copco Aktiebolag, Nacka, Sweden

[21] Appl. No.: 236,322

[22] Filed: Aug. 24, 1988

Related U.S. Application Data

[63] Continuation of Ser. No. 40,379, Apr. 20, 1987, abandoned.

[30] Foreign Application Priority Data

Apr. 22, 1986 [SE] Sweden ..... 8601834

[51] Int. Cl.[4] ..... B25D 15/00

[52] U.S. Cl. ..... 464/25

[58] Field of Search ..... 81/463, 465; 137/625.18, 625.19; 173/90, 93, 93.5; 464/24, 25

[56] References Cited

U.S. PATENT DOCUMENTS

| | | | |
|---|---|---|---|
| 3,098,506 | 7/1963 | Spragens | 137/625.19 |
| 3,191,404 | 6/1965 | Schivley, Jr. | 464/25 |
| 4,553,948 | 11/1985 | Tatsuno | 464/25 |

*Primary Examiner*—Daniel P. Stodola

*Attorney, Agent, or Firm*—Frishauf, Holtz, Goodman & Woodward

[57] ABSTRACT

A hydraulic torque impulse generator comprising a rotationally driven drive member (10; 50), a hydraulic fluid chamber (16; 51) confined in the drive member (10; 50), an output spindle (18; 53) having a rear impulse receiving portion (17; 52) extending into the fluid chamber (16; 51), at least two radially slidable vanes (23, 24; 58, 60) carried by the rear spindle portion (17; 52) and cooperating with corresponding seal portions (25, 26; 62, 63, 64) on the fluid chamber wall, axially extending seal ribs (29, 30; 65, 66, 67) on the fluid chamber wall and corresponding axially extending seal ribs (27, 28; 68, 70) on the rear spindle portion (17; 52). Simultaneous sealing cooperation is obtained more than once during each revolution of the drive member (10; 50) relative to the output spindle (18; 52), whereby the fluid chamber (16; 51) is momentarily divided into at least two high pressure compartments (H.P.) and at least two low pressure compartments (L.P.). A first passage mechanism (32–35; 74–78) in the drive member (10; 50) cooperates with a second passage mechanism (37, 38; 73) in the output spindle (18;53) to form bypass passages between the high pressure compartments (H.P.) and the low pressure compartments (L.P.) in all but one of the fluid chamber dividing positions, such that only one torque impulse per relative revolution between the drive member (10; 50) and the output spindle (18; 53) is generated.

15 Claims, 3 Drawing Sheets

HYDRAULIC TORQUE IMPULSE GENERATOR WITH BYPASS MECHANISM

This application is a continuation of application Ser. No. 040,329 filed Apr. 20, 1988 now abandoned.

BACKGROUND OF THE INVENTION

This invention relates to a hydraulic torque impulse generator of the type comprising a drive member coupled to a rotation motor, a substantially cylindrical fluid chamber confined in said drive member, an output spindle provided with a rear impulse receiving portion which extends into said fluid chamber, and at least two radially slidable vanes carried by said rear spindle portion and arranged to cooperate sealingly with corresponding seal portions on the wall of said fluid chamber, at least two axially extending seal ribs on the fluid chamber wall and at least two axially extending seal ribs on the rear spindle portion arranged to cooperate with said seal ribs on the fluid chamber wall, said vanes, seal portions and seal ribs being arranged to divide said fluid chamber during two or more limited intervals of each revolution of said drive member relative to said output spindle into at least two high pressure compartments and at least two low pressure compartments.

The main object of the invention is to provide a hydraulic torque impulse generator of the above type with means by which the generation of more than one torque impulse per revolution of the drive member in relation to the output spindle is avoided.

DETAILED DESCRIPTION

Figure 1:
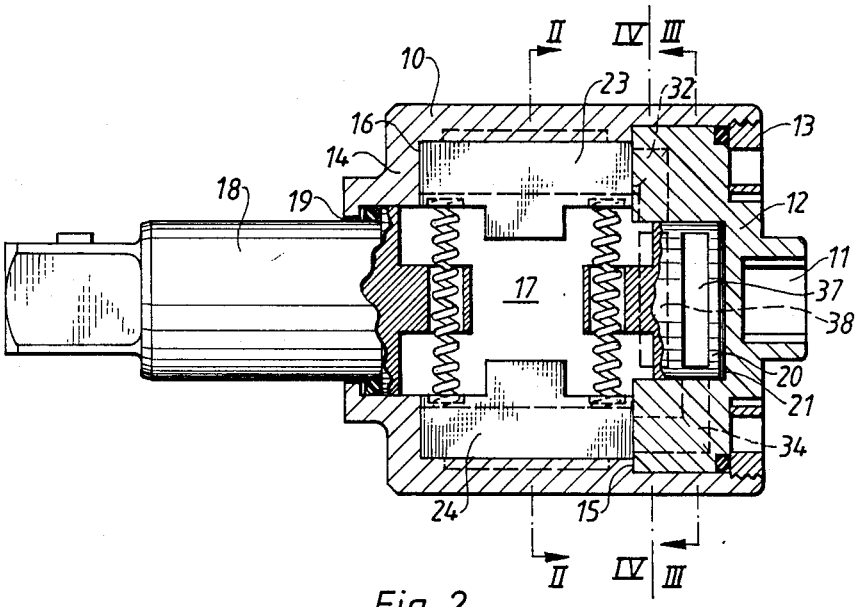
FIG. 1 shows a longitudinal section through an impulse generator according to one embodiment of the invention.
Figure 2:
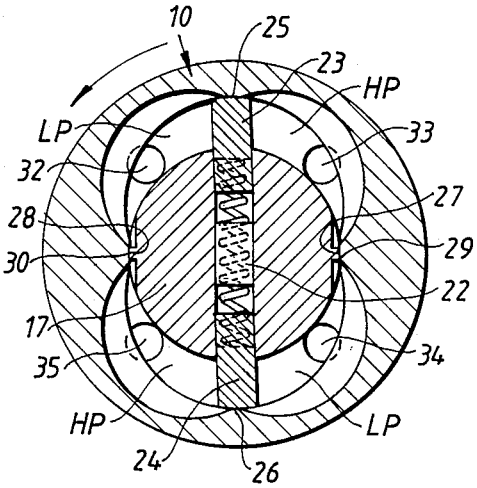
FIG. 2 shows a cross section along line II—II in FIG. 1.
Figure 3:
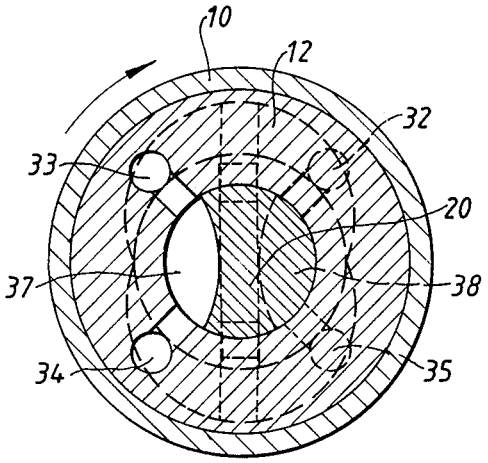
FIGS. 3 and 4 show cross sections along line III—III in FIG. 1 and illustrate different operation sequences.

In the torque impulse generator shown in FIGS. 1-4, 10 desgnates the drive member which via a socket portion 11 in a rear end wall 12 is connectable to a rotation motor. The rear end wall 12 is clamped by a ring nut 13 against an annular shoulder 15 in the drive member 10. The latter confines a substantially cylindrical fluid chamber 16 into which extends the rear portion 17 of an output spindle 18. The output spindle 18 is journalled on one hand in the central opening 19 of the forward end wall 14 of the fluid chamber 16 and on the other hand in a bore 21 in the rear end wall 12. To this end the spindle portion 17 is formed with a cylindrical rear extension 20 which is rotatively received in the bore 21.

The spindle portion 17 is formed with a transverse through slot 22 in which two sliding vanes 23, 24 are supported in a diametrically opposed disposition. The vanes 23, 24 are arranged to cooperate sealingly with two diametrically opposed and axially extending seal portions 25, 26 on the fluid chamber wall. Such sealing cooperation occurs twice every relative revolution between the drive member 10 and the output spindle 18.

Simultaneously with this sealing engagement two diametrically opposed seal ribs 27, 28 on the spindle portion 17 cooperate sealingly with two diametrically opposed seal ribs 29, 30 on the fluid chamber wall. The seal ribs 27, 28 on the spindle portion 17 are located at a 90° angular distance from the vanes 23, 24, and the seal ribs 29, 30 on the fluid chamber wall are disposed at a 90° angular distance from the seal portions 25, 26.

In the rear end wall 12 there are four passages 32, 33, 34, 35 which at their one ends are open into the fluid chamber 16. At their opposite ends these passages are open into the bore 21. Two of these passages 33, 34 are open to the bore 21 in one common plane III—III transverse to the rotation axis ofthe spindle 18, whereas the other two passages 32, 35 are open to the bore 21 in another transverse plane IV—IV axially spaced from plane III—III.

In the plane IV—IV the rear spindle extension 20 is formed with an arc-shaped slot 38 by which communication between the passages 32, 35 is controlled. In the plane III—III the spindle extension 20 has an arc-shaped slot 37 for controlling the communication between passages 34, 33. Slot 37 is located at a 180° angular distance from slot 38.

In operation the drive member 10 is rotated in relation to the output spindle 18, and during two limited intervals of each revolution of the drive member 10 relative to the output spindle 18 there is obtained a sealing cooperation between vanes 23, 24 and seal portions 25, 26 as well as between seal ribs 27, 28 on spindle portion 17 and seal ribs 29, 30 on the drive member 10. During these two intervals, illustrated in FIG. 3 and 4, the fluid chamber 16 is divided into two high pressure compartments H.P. and two low pressure compartments L.P. During one of these intervals the slot 37 interconnects the passages 33, 34, see FIG. 3. At the same time the slot 38 interconnects the passages 32, 35. This means that the two high pressure compartments H.P. are shortcircuited to the low pressure compartments L.P. and that no pressure peaks are built up in the high pressure compartments H.P. Accordingly, no torque impulse is generated during this sequence.

Figure 4:
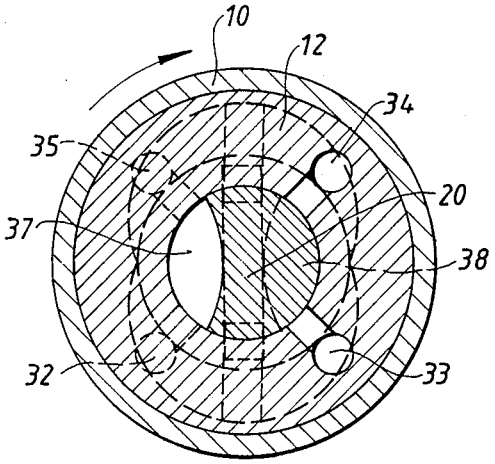

As the drive member 10 has rotated another 180°, see FIG. 4, the seals of the drive member and the output spindle are again effective in dividing the fluid chamber 16 into high and low pressure compartments, H.P. and L.P. respectively. In this position, however, the slots 37, 38 are out of communication with the passages 32-35 in the drive member 10, which means that no bypass flow is obtained and that the high pressure compartments H.P. actually are sealed off from the low pressure compartments L.P. Pressure peaks are built up in the high pressure compartments H.P. and a torque impulse is generated in the output spindle 18.

Figure 5:
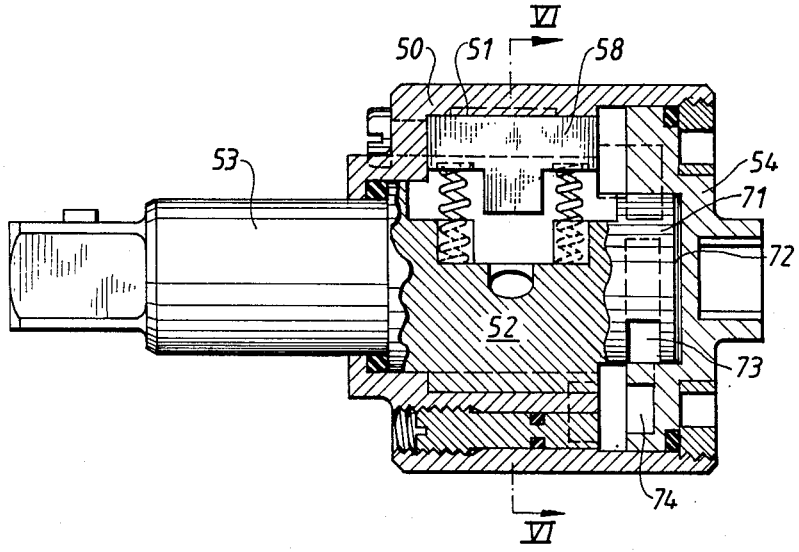
FIG. 5 shows a longitudinal section through an impulse generator according to another embodiment of the invention.
Figure 6:
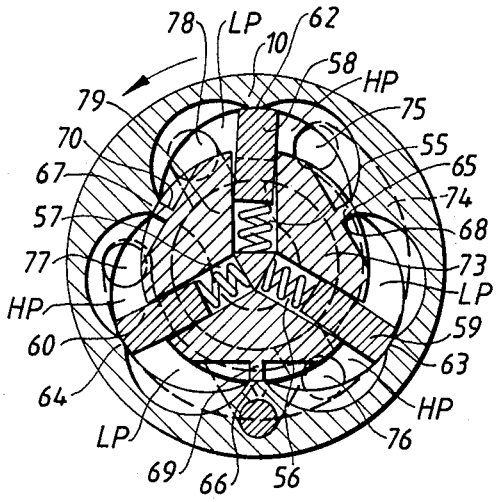
FIG. 6 shows a cross section along line VI—VI in FIG. 5.

In the embodiment shown in FIGS. 5 and 6 a rotated drive member 50 comprises a fluid chamber 51 which is partly defined by a rear end wall 54 and into which a rear portion 52 of an output spindle 53 extends. The rear spindle portion 52 has three radial slots 55, 56, 57 which are distributed at equal angular distances and which support three radially slidable vanes 58, 59, 60. On the fluid chamber wall there are three seal portions 62, 63, 64 for sealing cooperation with the vanes 58, 59, 60. Since both the vanes and the fluid chamber seal portions are symmetrically located there is obtained a sealing cooperation therebetween during three limited intervals for each revolution of the drive member 50 relative to the output spindle 53. The drive member 50 also comprises three symmetrically disposed seal ribs 65, 66, 67 for sealing cooperation with three corresponding seal ribs 68, 69, 70 on the spindle portion 52.

A concentric rear extension 71 on the output spindle 53 is sealingly rotated in a bore 72 in the rear end wall 54 and comprises a circumferential slot 73 which extends over a major part of the periphery. The slot 73 is interrupted by a land 79.

A part circular passage 74 in the rear end wall 54 interconnects three openings 75, 76, 77 which communicate with the three high pressure compartments H.P. A fourth opening 78 in end wall 54 opens into one of the three low pressure compartments L.P. The opening 78 communicates with the other two low pressure compartments L.P. via the vane slots 55, 56, 57.

At rotation of the drive member 50 relative to the output spindle 53, the high pressure compartments H.P. will communicate with the low pressure compartments L.P. via the openings 75, 76, 77, the part circular passage 74, the circumferential slot 73, the opening 78 and the vane slots 55, 56, 57 during two of the three seal intervals. In the third interval, illustrated in FIG. 6, the opening 78 is blocked by the land 79 and, accordingly, it is out of communication with the slot 73. This means that no bypass is obtained and that a torque impulse is generated in the output spindle 53.

We claim:

1. Hydraulic torque impulse generator comprising:

a drive member (10;50) coupled to a rotation motor;

a substantially cylindrical fluid chamber (16;51) defined in said drive member (10;50), said fluid chamber (16;51) having end walls (12;54);

an output spindle (18;53) provided with a rear impulse receiving portion (17;52) which extends into said fluid chamber (16;51);

at least two radially slidable vanes (23,24; 58–60) carried by said rear portion of said spindle (17;52) and arranged to sealingly cooperate with corresponding seal portions (25,26; 62–64) on a wall of said fluid chamber (16;51);

at least two axially extending seal ribs (29,30; 65–67) on said fluid chamber wall;

at least two axially extending seal ribs (27,28; 68–70) on said rear spindle portion (17;52) which are arranged to cooperate with said seal ribs (29,30; 65–67) on said fluid chamber wall;

said vanes (23,24; 58–60), said seal portions (25,26; 62–64) and said seal ribs (27–30; 65–70) being arranged to divide said fluid chamber (16;51), during at least two limited intervals of each revolution of said drive member (10;50) relative to said output spindle (18;53), into at least two high pressure compartments (H.P.) and at least two low pressure compartments (L.P.);

first passage means (32–35; 74–78) located in an end wall (12;54) of said fluid chamber (16;51);

second passage means (37,38; 73) located in said output spindle (18;53); and said first and second passage means being arranged to be aligned and form bypass passages between said high pressure compartments (H.P.) and said low pressure compartments (L.P.) during all but one of said limited intervals of each revolution of said drive member (10;50) relative to said output spindle (18;53), thereby generating one torque impulse per revolution.

2. Impulse generator according to claim 1, wherein:

one of said end walls of said fluid chamber is a rear end wall; and said first passage means (32–35; 74–78) is located in said rear end wall (12;54) of said fluid chamber (16;51) opening into a central axially extending bore (21;72) in said rear end wall; and said second passage means (37,38; 73) is located in a rear extension (20; 71) of said output spindle (18;53), said rear extension (20; 71) being of cylindrical shape and being received in said axially extending bore (21;72).

3. Impulse generator according to claim 2 wherein:

said vanes (23,24) and said corresponding seal portions (25,26) on said fluid chamber wall are two in number, and are arranged to sealingly cooperate during two limited intervals of each revolution of said drive member (10) relative to said output spindle (18); and said first and second passage means (32–35, 37,38) are arranged to form bypass passages between said high pressure compartments (H.P.) and said low pressure compartments (L.P.) in one of said two intervals, thereby avoiding a torque impulse generation during said one of said two intervals.

4. Impulse generator according to claim 1 wherein:

said vanes (23,24) and said corresponding seal portions (25,26) on said fluid chamber wall are two in number, and are arranged to sealingly cooperate during two limited intervals of each revolution of said drive member (10) relative to said output spindle (18); and said first and second passage means (32–35, 37,38) are arranged to form bypass passages between said high pressure compartments (H.P.) and said low pressure compartments (L.P.) in one of said two intervals, thereby avoiding a torque impulse generation during said one of said two intervals.

5. Impulse generator according to claim 1, wherein:

said end wall of said fluid chamber in which said first passage means is located comprises a substantially central bore therein;

said rear portion of said spindle (17; 52) being said first passage means comprises openings in said end wall in which said first passage means is located, for communication with said second passage means (37, 38; 73) in said spindle (17; 52).

6. Impulse generator according to claim 5, wherein said openings in said end wall comprise substantially radial openings.

7. Impulse generator according to claim 5, wherein said first passage means opens into said second passage means.

8. Impulse generator according to claim 5, wherein said first passage means is located in only one of said end walls of said fluid chamber.

9. Impulse generator according to claim 1, wherein: said end wall of said fluid chamber in which said first passage means is located comprises a substantially central bore, and wherein that part of said output spindle in which said second passage means is located is sealingly journalled in said substantially central bore.

10. Impulse generator according to claim 9, wherein said first passage means comprises openings in said end wall of said fluid chamber in which said first passage means is located.

11. Impulse generator according to claim 10, wherein said openings in said end wall comprise substantially radial openings.

12. Impulse generator according to claim 11, wherein said openings in said end wall are arranged to provide communication with said substantially central bore.

13. Impulse generator according to claim 10, wherein said openings in said end wall are arranged to provide communication with said substantially central bore.

14. Impulse generator according to claim 10, wherein said first passage means is located in only one of said end walls of said fluid chamber.

15. Impulse generator according to claim 1, wherein said first passage means is located in only one of said end walls of said fluid chamber.

* * * * *

UNITED STATES PATENT AND TRADEMARK OFFICE

CERTIFICATE OF CORRECTION

PATENT NO. : 4,854,916

DATED : August 8, 1989

INVENTOR(S) : SCHOEPS et al

It is certified that error appears in the above-identified patent and that said Letters Patent is hereby corrected as shown below:

Column 4, (claim 5), between lines 42 and 43, insert the following:

--rotatively received in said substantially central bore; and--.

Signed and Sealed this

Twenty-seventh Day of November, 1990

*Attest:*

HARRY F. MANBECK, JR.

*Attesting Officer*

*Commissioner of Patents and Trademarks*